US007750857B2

(12) United States Patent
Kim

(10) Patent No.: US 7,750,857 B2
(45) Date of Patent: Jul. 6, 2010

(54) MOBILE TERMINAL

(75) Inventor: Jung-Ha Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 254 days.

(21) Appl. No.: 11/970,735

(22) Filed: Jan. 8, 2008

(65) Prior Publication Data

US 2008/0165067 A1 Jul. 10, 2008

(30) Foreign Application Priority Data

Jan. 9, 2007 (KR) ..... 10-2007-0002562

(51) Int. Cl.
*H01Q 1/24* (2006.01)

(52) U.S. Cl. ..... 343/702

(58) Field of Classification Search ..... 343/702, 343/872; 455/90.3, 575.1, 575.3, 575.4, 455/575.7

See application file for complete search history.

(56) References Cited

U.S. PATENT DOCUMENTS 6,985,110 B2 * 1/2006 Tanaka et al. ..... 343/702

* cited by examiner

*Primary Examiner*—Hoang V Nguyen
(74) *Attorney, Agent, or Firm*—Lee, Hong, Degerman, Kang & Waimey

(57) ABSTRACT

A mobile terminal includes: a terminal casing including a first casing and a second casing combined with the first casing; an external antenna mounted on an external surface of the terminal casing; an internal antenna mounted within the terminal casing; and at least one fastening screw that fastens the first and second casings and electrically connects the external and internal antennas. The size and thickness of the terminal can be reduced.

19 Claims, 5 Drawing Sheets

MOBILE TERMINAL

CROSS REFERENCE TO RELATED APPLICATIONS

This application claims priority to Korean Application No. 10-2007-0002562, filed Jan. 9, 2007, and is herein incorporated by reference in the entirety.

BACKGROUND OF THE INVENTION

1. Field of the Invention

The present invention relates to a mobile terminal and, more particularly, to a mobile terminal with a metallic element at an outer surface of a terminal casing that can be used as an antenna.

2. Description of the Related Art

Recently, a mobile terminal with an internal antenna, in which an antenna that transmits or receives radio signals is installed, rather than being protruded to outside of the mobile terminal, to make the mobile terminal aesthetically fine, is widely used.

However, such a mobile terminal with the internal antenna has a problem in that because the antenna is installed in the terminal, a space for mounting the antenna should be secured within the terminal, and in this case, the antenna installation position is limited to avoid a frequency interference with other components, resulting in the increase in the thickness and size of the mobile terminal.

Thus, in order to solve such problem, a method for using a metallic external object that may be mounted on an outer surface of a terminal casing is being developed.

However, the use of the metallic external object as an antenna requires a connection member for electrically connecting the metallic external object serving as the antenna and a printed circuit board (PCB) with a communication module mounted thereon. This causes the necessity of securing a space for installing he connection member within the terminal and also a fastening structure for fastening the connection member. Thus, the thickness and size of the terminal are still increased.

SUMMARY OF THE INVENTION

Therefore, in order to address the above matters the various features described herein have been conceived. One aspect of the exemplary embodiments is to provide a mobile terminal in which a fastening screw for fastening a terminal casing serves as a connection terminal that electrically connects an antenna mounted on an outer surface of the terminal casing and a printed circuit board (PCB) mounted within the terminal casing, and the length of the fastening screw can be used as a resonance length of the antenna, to thus reducing the size and thickness of the mobile terminal.

This specification provides a mobile terminal that may include: a terminal casing including a first casing and a second casing combined with the first casing; an external antenna mounted on an external surface of the terminal casing; an internal antenna mounted within the terminal casing; and at least one fastening screw that fastens the first and second casings and electrically connects the external and internal antennas.

With the additional length of the fastening screws, the external antenna and the internal antenna may then form a total length that corresponds to a resonance frequency bandwidth required for the mobile terminal. Accordingly, the internal antenna itself may have a smaller length and volume, and thus the overall size of the mobile terminal can be made smaller or additional components may be mounted in the mobile terminal due to the space saved by employing the fastening screw as part of the total antenna length.

A printed circuit board (POB) is provided within the terminal casing, with which the internal antenna may be connected to be fed. In this case, the fastening screw may be electrically connected with the PCB to replace a feeding means.

A screw fastening part which is made of a metallic material and where the screw is fastened may be formed at either the first casing or the second casing, to firmly support the screw.

The external antenna may include a first antenna attached on one side of the external surface of the terminal casing; and a second antenna disposed spaced apart from the first antenna and attached to the other side of the extern surface of the terminal casing. Namely, an element such as a plurality of metallic ornaments (decorations) separated from the exterior of the terminal casing may be utilized as an antenna emitter.

One end of the internal antenna may be connected with the first antenna by the fastening screw and the other end thereof may be connected with the second antenna by the fastening screw. In this case, the internal antenna may be positioned between the first and second antennas, and may be disposed to be parallel with the first and second antennas.

The fastening screw may include: a first fastening screw that is fastened in a fastening hole formed at one end of the terminal casing, contacts with the first antenna, and is combined by passing through a ground hole formed at one end of the internal antenna; and a second fastening screw which is fastened in a fastening hole formed at the other end of the terminal casing, contacts with the second antenna, and is combined by passing through a ground hole formed at the other end of the internal antenna. Namely, the fastening screw may formed to connect the internal and external antennas at multiple positions.

The first and second fastening screws may be formed to have respectively different lengths, which allow the length of the connection between the internal antenna and the external antenna to be adjustable, such that signal frequency tuning of the antennas would be possible.

This specification also provides a mobile terminal that may include a terminal casing including a first casing and a second casing combined with the first casing; an external antenna mounted on an outer surface of the terminal casing; an internal antenna disposed to be movable within the terminal casing; a fastening screw that fastens the first and second casings and is connected with the external antenna; and sockets that are attached to both ends of the internal antenna, screw-fastened to the fastening screw and varies the resonance length while being moved according to rotation of the fastening screw.

The internal antenna may be disposed to be movable at an inner surface of the terminal casing and may be formed of a metallic plate with an antenna pattern.

The socket is formed as a pair of sockets and attached to both ends of the internal antenna so as to be moved together with the internal antenna, and a female thread grooves may be formed on inner surfaces of the pair of sockets in which the fastening screw is fastened.

An elastic support body may be further mounted on the sockets in order to maintain the fastening screw-fastened state. Accordingly, the elastic support may control a connection length of the fastening screw for turning the antenna while uniformly obtaining a fastening force of the fastening screw. In this case, the elastic support may be formed as a plate spring installed to be protruded in an inward direction of the socket.

This specification also provides a mobile terminal that may include: a terminal casing including a first casing and a second casing combined with the first casing; an external antenna mounted on an outer surface of the terminal casing; an internal antenna mounted within the terminal casing and feeing power to a circuit board disposed within the terminal casing; and at least one fastening screw that fastens the first and second casings and electrically connects the external and internal antennas.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The mobile terminal according to exemplary embodiments of the present invention will now be described with reference to the accompanying drawings.

Figure 1:
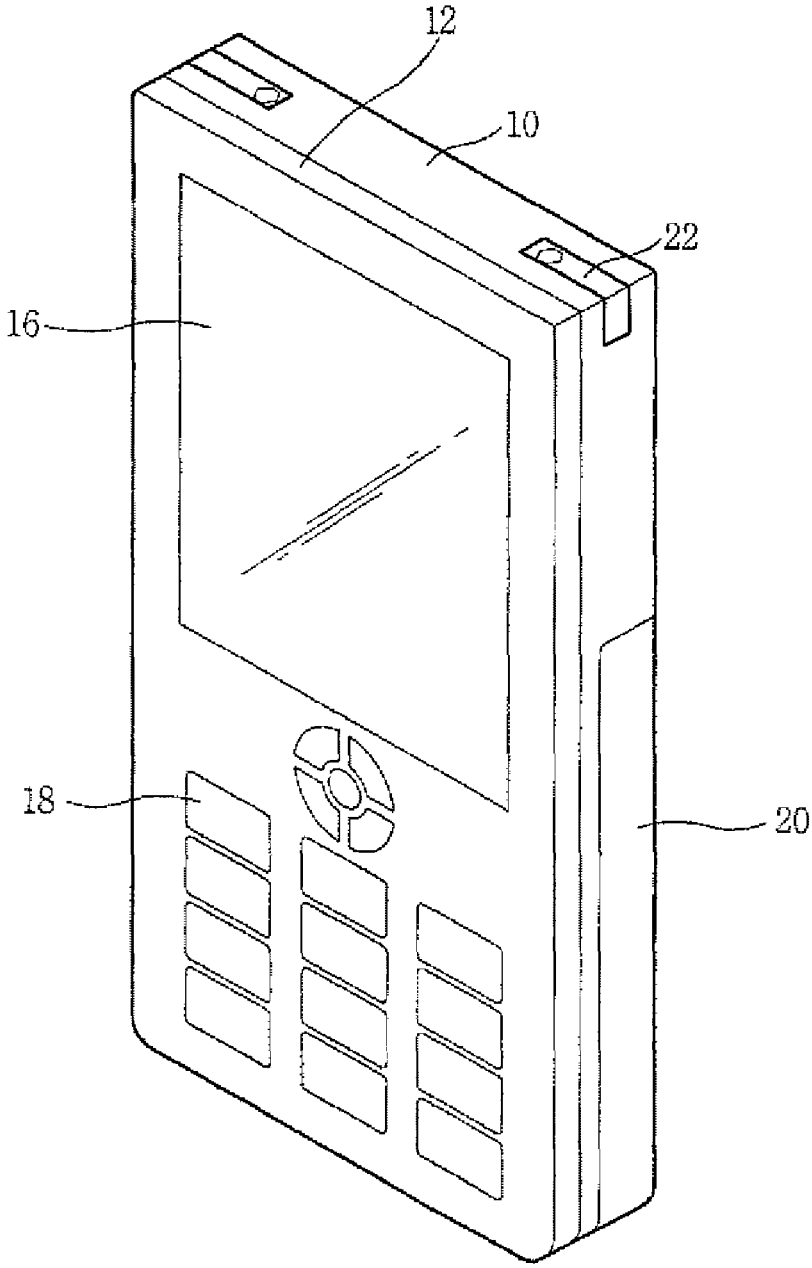
FIG. 1 is a perspective view of a mobile terminal according to a first exemplary embodiment of the present invention.
Figure 2:
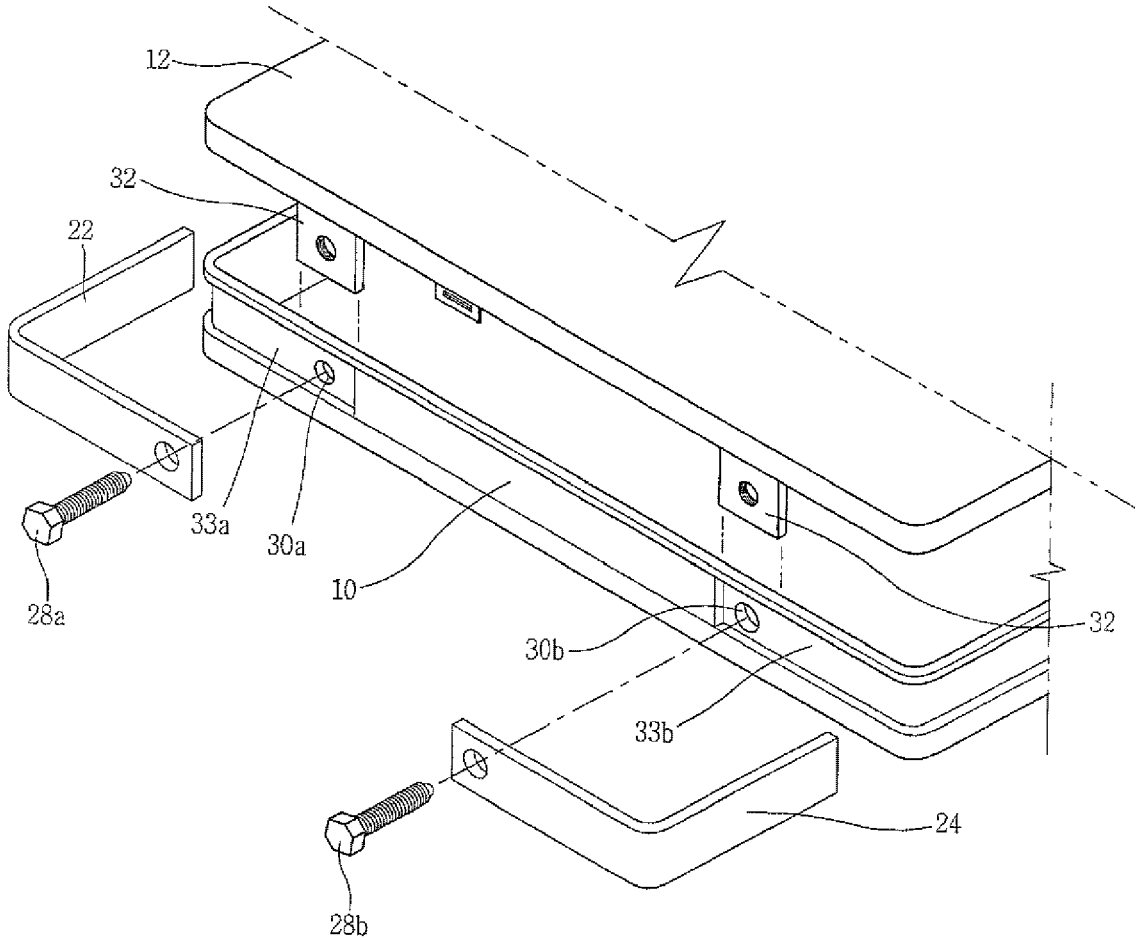
FIG. 2 is an exploded perspective view of a terminal casing of a mobile terminal according to the first exemplary embodiment of the present invention.
Figure 3:
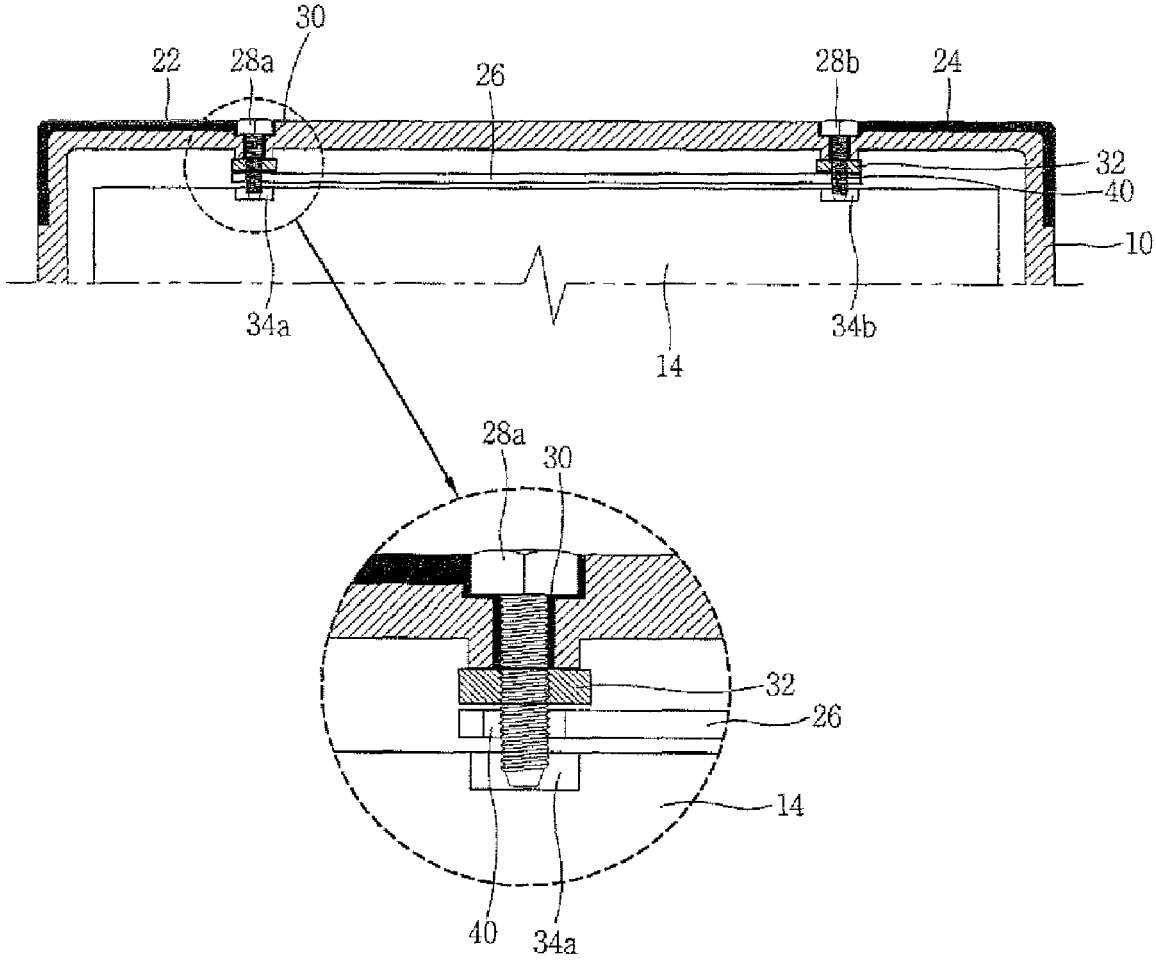
FIG. 3 is a partial sectional view of the mobile terminal according to the first exemplary embodiment of the present invention.

FIG. 1 is a perspective view of a mobile terminal according to a first exemplary embodiment of the present invention, FIG. 2 is an exploded perspective view of a terminal casing of a mobile terminal according to the first exemplary embodiment of the present invention, and FIG. 3 is a partial sectional view of the mobile terminal according to the first exemplary embodiment of the present invention.

The mobile terminal according to the first exemplary embodiment of the present invention includes terminal casings 10 and 12, a PCB (Printed Circuit Board) 14 disposed within the terminal casings 10 and 12; a display 16 disposed on a front surface of the terminal casing 12 and displaying information; an input unit 18 disposed on the front surface of the terminal casing 12 and inputting information; a battery 20 mounted on a rear surface of the terminal casing 10 and supplying power; and antennas 22, 24 and 26 mounted at the terminal casings 10 and 12 and transmitting and receiving radio signals.

The mobile terminal may be applicable to any other types of mobile terminals such as a folder type mobile terminal that includes a first body having an input unit for inputting information and a second body rotatably connected with the first body and having a display for displaying information, a slide type mobile terminal that includes the first body mounted to be slidably moved with respect to the second body; and a swing type mobile terminal that includes the first body connected to be horizontally rotatable with respect to the second body.

The terminal casings 10 and 12 refer to the first casing 10 and the second casing 12 fastened to the first casing 10 by a fastening screw 26, and the antennas 22, 24 and 26 that transmit and receive radio signals are mounted at the first casing 10.

Preferably, the first and second casings 10 and 12 are made of a resin material.

The antenna includes the external antennas 22 and 24 mounted to be exposed from the outer surface of the first casing 10 to serve as a decoration to aesthetically improve design and transmitting and receiving radio signals, and the internal antenna 26 mounted on an inner surface of the first casing 10 and connected with the external antennas 22 and 24.

Here, antenna mounting recesses 33*a* and 33*b* are formed in a circumferential direction at the side of the first casing 10, in which the external antennas 22 and 24 are mounted. The antenna mounting recesses 33*a* and 33b have the same depth as the thickness of the external antennas 22 and 24 so that the external antennas 22 and 24 cannot be protruded from the surface of the first casing 10.

The external antennas 22 and 24 refer to the first antenna 22 mounted on the surface of an edge portion of one side of the first casing 10 and the second antenna 24 mounted on the surface of an edge portion of the other side of the first casing 10.

Preferably, the external antennas 22 and 24 are formed as a thin metallic plate attached to the external surfaces of the first casing 10, and may have a pattern.

The external antennas 22 and 24 are mounted on the outer surfaces of the first casing 10 to allow radio signals to be transmitted and received, and also serve as a metallic decoration (or ornament) for aesthetically enhancing the design of the terminal.

Through holes 30*a* and 30*b* are formed at portions of the first casing 10 where the external antennas 22 and 24 are mounted, through which fastening screws 28*a* and 28*b* pass, and screw fastening portions 32*a* and 32*b* are formed at the second casing 12, through which the fastening screws 28*a* and 28*b* are fastened. Preferably, the screw fastening portions 32*a* and 32*b* are made of a metallic plate material in order to firmly support the screws 28*a* and 28*b*.

The fastening screws 28*a* and 28*b* are electrically connected with the PCB 14 mounted within the terminal casings 10 and 12. Namely, end portions of the fastening screws 28*a* and 28*b* contact with and are electrically connected with an edge portion of the PCB 14, and connection terminals 34*a* and 34*b* are formed to be connected with a communication module mounted on the PCB 14.

The internal antenna 26 is mounted on the inner surface of the first casing 10, formed as a metallic plate with an antenna pattern, and horizontally disposed between the first and second antennas 22 and 24.

Here, the internal antenna 26 includes ground holes 40, through which the fastening screws 28 pass, formed at both end portions thereof, and electrically connected with the external antennas 22 and 24 by the fastening screws 28*a* and 28*b*. Namely, one end of the internal antenna 26 is connected with the external antenna 22 by the fastening screw 28*a* and the other end of the internal antenna 26 is connected with the external antenna 24 by the fastening screw 28*b*.

Accordingly, the resonance length of the antenna is the sum of the length of the external antennas 22 and 24, the length of the fastening screws 28*a* and 28*b*, and the length of the internal antenna 26. The reason why the internal antenna 26 is installed at the inner surface of the terminal casing 10 is to advantageously lengthen the resonance length and minimize damage that may be caused by a hand effect. The external antennas 22 and 24 may easily contact with and be affected by the human body such as the user's hand or head, while the internal antenna 26 is separately disposed spatially from the external antennas 22 and 24, having a certain wireless performance, resulting in reduction in degradation of the antenna performance. Namely, as shown in the Figures, the external antennas 22 and 24 may be mounted on both sides of the upper surface of the terminal casing 10 and the internal antenna 26 may be mounted at the central portion of the inner surface of the terminal casing 10. In other words, because no antenna is installed at (or near) the central portion of the outer surface of the terminal casing 10, the antenna region being covered or blocked by the user (such as the user's hand being used to hold the terminal during use) is minimal, to thus reduce the influence caused by the so-called "hand effect" (i.e., signal interference or affects caused by the user's hand over the antenna).

The assembling process of the mobile terminal according to the present invention will now be described. The external antennas 22 and 24 are attached to the outer surface of the terminal casing 10, and the internal antenna 26 is attached to the inner surface of the terminal casing 10. The antennas are conductors made of a metallic material and having an antenna pattern.

The first and second casings 10 and 12 are fastened by using the fastening screws 28*a* and 28*b*. In this case, the fastening screws 28*a* and 28*b* pass through the through holes 30*a* and 30*b* formed at the first casing 10, allowing each head portion to contact with the external antennas 22 and 24, and then pass through the ground hole 40 of the internal antenna 26 formed on the inner surface of the first casing 10, thus electrically connecting the external antennas 22 and 24 and the internal antenna 26.

And the fastening screws 28*a* and 28*b* fasten the screw fastening portions 32*a* and 32*b* formed at the second casing 12 and are inserted into the connection terminals 34*a* and 34*b* formed on the PCB 14 to electrically connect them.

Then, as the external antennas 22 and 24 and the internal antenna 26 are electrically connected by the fastening screws 28*a* and 28*b*, the sum of the length of the external antennas 22 and 24, the length of the internal antenna 26, and the length of the fastening screws 28*a* and 28*b* is equivalent to the overall resonance length of the antennas. Because the end portions of the fastening screws 28*a* and 28*b* are connected with PCB 14, they can be used as an antenna feeding terminal or a ground terminal.

Figure 4:
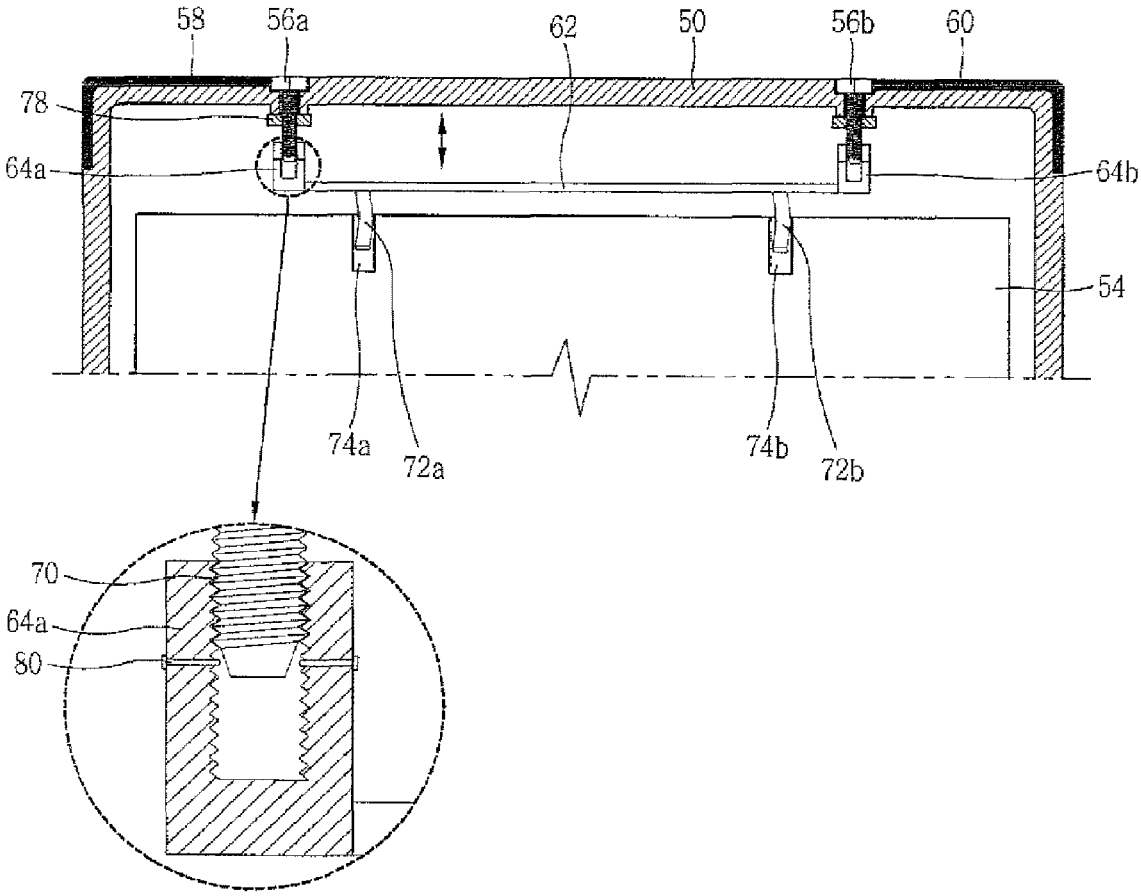
FIG. 4 is a partial sectional view of a mobile terminal according to a second exemplary embodiment of the present invention.
Figure 5:
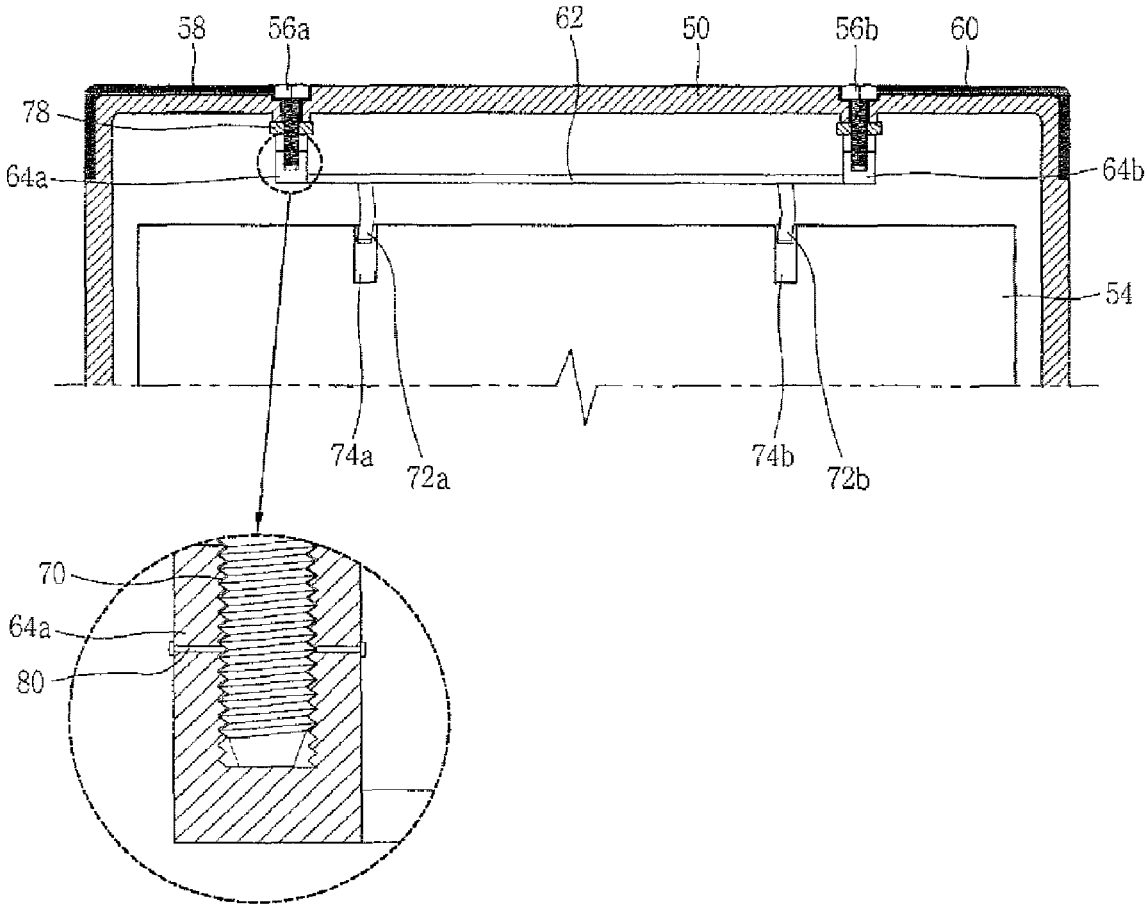
FIG. 5 is view showing an operational state of the mobile terminal according to the second exemplary embodiment of the present invention.

FIG. 4 is a partial sectional view of a mobile terminal according to a second exemplary embodiment of the present invention.

The mobile terminal according to the second exemplary embodiment of the present invention includes: a terminal casing 50, a PCB 54 disposed within the terminal casing 50, fastening screws 56*a* and 56*b* that fasten the terminal casing 50, external antennas 58 and 60 attached to an outer surface of the terminal casing 50, an internal antenna 62 movably positioned on an inner surface of the terminal casing 50, and sockets 64*a* and 64*b* connected with both ends of the internal antenna 62, allowing the fastening screws 56*a* and 56*b* to be fastened therein, and varying the resonance length of the antennas while linearly moving according to rotation of the fastening screws 56*a* and 56*b*.

The external antennas 58 and 60 have the same structure as the external antennas 22 and 24 as described in the first embodiment of the present invention, so its description will be omitted.

The internal antenna 62 is made of a metallic plate and movably disposed within the terminal casing 50.

The fastening screws 56*a* and 56*b* having a different length can be used according to the resonance length of the antennas. Namely, when the resonance length is intended to be short, a shorter fastening screw may be used. When the resonance length is intended to be long, a longer fastening screw may be used.

The fastening screws 56*a* and 56*b* pass through the terminal casing 50 so as to be fastened in a screw fastening portion 78 of a second terminal casing (not shown) to thus fasten the first terminal casing 50 and the second terminal casing (not shown).

The sockets 64*a* and 64*b* are attached to the both ends of the internal 25 antenna 62 and moved together with the internal antenna 62. Female thread grooves where the fastening screws 64*a* and 64*b* are fastened are made of a metallic material so as to serve as an antenna.

A release preventing elastic body 80 is mounted on the inner surface of the sockets 64*a* and 64*b* in order to prevent the fastening screws 56*a* and 56*b* from being released from the sockets 64*a* and 64*b* when fastened. Here, the release preventing elastic body 80 is a plate spring type of elastic body installed to be protruded in an inward direction of the sockets 64*a* and 64*b*. The release preventing elastic body 80 elastically contacts with the outer circumferential surface of the fastening screws 56*a* and 56*b* to support the fastening screws 56a and 56*b* such that they can be maintained at the current positions.

Connection terminals 72*a* and 72*b* are formed to extend from the sockets 64*a* and 64*b* or the internal antenna 62 and slidably moved in a state of contacting with connection terminals 74*a* and 74*b* formed at the PCB 54. In this case, the connection terminals 72*a* and 72*b* are made of a material with certain elasticity and elastically contacts with the connection terminals 74*a* and 74*b* so that the connection terminals 72*a* and 72*b* cannot be separated from the connection terminals 74*a* and 74*b*.

The operation of the mobile terminal according to the second exemplary embodiment of the present invention constructed as described above will now be explained.

First, when the resonance length of the antennas is intended to be short, the fastening screws 56*a* and 56*b* are rotated in a tightening direction. Then, because the fastening screws 56*a* and 56*b* are fastened at the female thread grooves 70 of the sockets 64*a* and 64*b*, the sockets 64*a* and 64*b* are lifted, shortening the overall length of the fastening screws 56*a* and 56*b* and the sockets 64*a* and 64*b* to thus shorten the overall resonance length of the antennas.

When the resonance length of the antennas is intended to be long, the fastening screws 56*a* and 56*b* are rotated in a releasing direction. Then, the sockets 64*a* and 64*b* are lowered, lengthening the overall length of the sockets 64*a* and 64*b* and the fastening screws 56*a* and 56*b* to thus lengthen the overall resonance length of the antennas.

In this manner, the fastening screws 56*a* and 56*nb* can be rotated in the tightening direction or in the releasing direction to vary the resonance length of the antennas.

As so far described, the mobile terminal according to the present invention has the following advantages.

That is, the external antennas that also serves as a decoration are attached on the outer surface of the terminal casing and the internal antenna is installed on the inner surface of the terminal casing, and the two antennas are connected by using the fastening screws used for fastening the antenna casings. And then, the fastening screws are connected with the PCB so as to serve as the feeding line and the ground line. Therefore, a connection member for connecting the antenna and the PCB is not necessary, and the fabrication cost can be reduced. In addition, because no space for allowing the connection member to pass therethrough is required, the size and thickness of the terminal can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal casing comprising a first casing and a second casing combined with the first casing;

an external antenna mounted on an external surface of the terminal casing;

an internal antenna mounted within the terminal casing; and at least one fastening screw that fastens the first and second casings and electrically connects the external and internal antennas, wherein the external antenna comprises:

a first antenna attached on one side of the external surface of the terminal casing; and a second antenna attached to the other side of the external surface of the terminal casing and located apart from the first antenna.

2. The mobile terminal of claim 1, wherein, with the additional length of the fastening screws, the external antenna and the internal antenna form a total length that corresponds to a resonance frequency bandwidth required for the mobile terminal.

3. The mobile terminal of claim 1, wherein a printed circuit board (PCB) is provided within the terminal casing, and the internal antenna is connected with the PCB so as to be fed.

4. The mobile terminal of claim 3, wherein the fastening screw is electrically connected with the PCB.

5. The mobile terminal of claim 1, wherein a screw fastening part which is made of a metallic material and where the screw is fastened is formed at either the first casing or the second casing.

6. The mobile terminal of claim 1, wherein one end of the internal antenna is connected with the first antenna by the fastening screw and the other end of the internal antenna is connected with the second antenna by the fastening screw.

7. The mobile terminal of claim 1, wherein the internal antenna is positioned between the first and second antennas, and is disposed to be parallel with the first and second antennas.

8. The mobile terminal of claim 1, wherein the fastening screw comprises:

a first fastening screw that is fastened in a fastening hole formed at one end of the terminal casing, contacts with the first antenna, and is combined by passing through a ground hole formed at one end of the internal antenna; and a second fastening screw which is fastened in a fastening hole formed at the other end of the terminal casing, contacts with the second antenna, and is combined by passing through a ground hole formed at the other end of the internal antenna.

9. The mobile terminal of claim 8, wherein the first and second fastening screws are formed to have respectively different lengths.

10. A mobile terminal comprising:

a terminal casing comprising a first casing and a second casing combined with the first casing;

an external antenna mounted on an outer surface of the terminal casing;

an internal antenna disposed to be movable within the terminal casing; a fastening screw that fastens the first and second casings and is connected with the external antenna; and sockets that are attached to both ends of the internal antenna, screw-fastened to the fastening screw and varies the resonance length while being moved according to rotation of the fastening screw.

11. The mobile terminal of claim 10, wherein the external antenna comprises:

a first antenna attached on one portion of an outer surface of the terminal casing; and a second antenna disposed spaced apart from the first antenna.

12. The mobile terminal of claim 10, wherein the internal antenna is disposed to be movable at an inner surface of the terminal casing and is formed of a metallic plate with an antenna pattern.

13. The mobile terminal of claim 10, wherein the socket is formed as a pair of sockets and attached to both ends of the internal antenna so as to be moved together with the internal antenna, and female thread grooves are formed on inner surfaces of the pair of sockets in which the fastening screw is fastened.

14. The mobile terminal of claim 13, wherein an elastic support body is mounted on the sockets in order to maintain the fastening screw-fastened state.

15. The mobile terminal of claim 14, wherein the elastic support is formed as a plate spring installed to be protruded in an inward direction of the socket.

16. A mobile terminal comprising:

a terminal casing comprising a first casing and a second casing combined with the first casing;

an external antenna mounted on an outer surface of the terminal casing;

an internal antenna mounted within the terminal casing and providing power to a circuit board disposed within the terminal casing; and at least one fastening screw that fastens the first and second casings and electrically connects the external and internal antennas, wherein an antenna mounting recess is formed on a side of the terminal casing to allow the external antennal to be mounted thereon.

17. The mobile terminal of claim 16, wherein, with the additional length of the fastening screws, the external antenna and the internal antenna form a total length that corresponds to a resonance frequency bandwidth required for the mobile terminal.

18. The mobile terminal of claim 16, wherein a connection terminal is formed to extend from the internal antenna and electrically connected with the PCB.

19. The mobile terminal of claim 16, wherein the fastening screw has such a length as to allow one end of the fastening screw to contact with one end of the external antenna and the other end of the fastening screw to contact with the internal antenna.

* * * * *